US007003861B2

(12) United States Patent
Sawdon et al.

(10) Patent No.: US 7,003,861 B2
(45) Date of Patent: Feb. 28, 2006

(54) TOOL ASSEMBLY EMPLOYING A FLEXIBLE RETAINER

(75) Inventors: Edwin G. Sawdon, St. Clair, MI (US); Steven J. Sprotberry, Marysville, MI (US); Stephen E. Sawdon, Marysville, MI (US)

(73) Assignee: BTM Corporation, Marysville, MI (US)

( * ) Notice: Subject to any disclaimer, the term of this patent is extended or adjusted under 35 U.S.C. 154(b) by 0 days.

(21) Appl. No.: 10/933,935

(22) Filed: Sep. 3, 2004

(65) Prior Publication Data

US 2005/0034291 A1 Feb. 17, 2005

Related U.S. Application Data

(62) Division of application No. 10/219,775, filed on Aug. 15, 2002, now Pat. No. 6,785,959.

(51) Int. Cl.
*B23P 19/00* (2006.01)

(52) U.S. Cl. ..... 29/432; 29/432.1; 29/505; 29/521; 29/283.5; 72/466.8

(58) Field of Classification Search ..... 29/432, 29/432.1, 505, 509, 521, 243.5, 283.5, 798, 29/21.1; 72/466.8, 466.4, 466.5; 24/16 PB
See application file for complete search history.

(56) References Cited

U.S. PATENT DOCUMENTS

| | | | |
|---|---|---|---|
| 1,404,126 | A | 1/1922 | Krause |
| 2,670,885 | A | 3/1954 | Allen |
| 3,359,935 | A | 12/1967 | Rosbottom |
| 3,404,648 | A | 10/1968 | Rosbottom |
| 3,468,527 | A | 9/1969 | Mather |
| 3,690,141 | A | 9/1972 | Brownbill |
| 3,881,792 | A | 5/1975 | Orain |
| 3,918,858 | A | 11/1975 | Imaizumi |
| 3,999,745 | A | 12/1976 | Mahoff |
| 4,196,944 | A | 4/1980 | Simatovich |
| 4,208,776 | A | 6/1980 | Schleicher |
| 4,660,403 | A | 4/1987 | Slasinski |
| 4,757,609 | A | 7/1988 | Sawdon |
| 4,825,525 | A | 5/1989 | Obrecht et al. |
| 4,905,362 | A | 3/1990 | Obrecht et al. |
| 4,910,853 | A | 3/1990 | Sawdon |
| 4,930,203 | A | 6/1990 | Obrecht et al. |

(Continued)

FOREIGN PATENT DOCUMENTS

| | | |
|---|---|---|
| AU | 206465 | 10/1954 |

(Continued)

OTHER PUBLICATIONS

European Search Report completed Nov. 13, 2003 for EP 03 25 4813.

*Primary Examiner*—David P. Bryant
*Assistant Examiner*—Jermie E. Cozart
(74) *Attorney, Agent, or Firm*—Harness, Dickey & Pierce, P.L.C.

(57) ABSTRACT

A flexible retainer for retaining die blades in a tool assembly. The retainer comprises inner and outer walls with the inner wall being generally concentric with and radially spaced inward from the outer wall. The inner wall defines a central opening in the retainer which is configured and adapted to extend radially around the die blades so that the retainer retains the die blades in the die assembly while allowing radial movement of the die blades. The retainer may have at least one channel that extends axially between the inner and outer walls.

22 Claims, 3 Drawing Sheets

U.S. PATENT DOCUMENTS

| | | | |
|---|---|---|---|
| 4,947,719 | A | 8/1990 | Whisler |
| 4,988,246 | A | 1/1991 | Yoshida et al. |
| 5,027,503 | A | 7/1991 | Sawdon |
| 5,051,020 | A | 9/1991 | Schleicher |
| 5,054,347 | A | 10/1991 | Johnson et al. |
| 5,087,188 | A | 2/1992 | Staver |
| 5,150,513 | A | 9/1992 | Sawdon |
| 5,177,861 | A | 1/1993 | Sawdon |
| 5,207,086 | A | 5/1993 | Kynl, deceased |
| 5,263,238 | A | 11/1993 | Cooper |
| 5,267,383 | A | 12/1993 | Sawdon |
| 5,339,509 | A | 8/1994 | Sawdon et al. |
| 5,438,897 | A | 8/1995 | Chun |
| 5,451,288 | A | 9/1995 | Smith et al. |
| 5,479,687 | A | 1/1996 | Sawdon |
| 5,509,290 | A | 4/1996 | Faivre |
| 5,528,815 | A | 6/1996 | Webb |
| 5,581,860 | A | 12/1996 | Sawdon |
| 5,709,019 | A | 1/1998 | Sawdon |
| 5,727,302 | A | 3/1998 | Sawdon |
| 5,737,819 | A | 4/1998 | Sawdon et al. |
| 5,782,130 | A | 7/1998 | Sawdon |
| 5,833,245 | A | 11/1998 | Gallagher |
| 5,984,563 | A | 11/1999 | Wu |
| 6,092,270 | A | 7/2000 | Sawdon |

FOREIGN PATENT DOCUMENTS

| | | |
|---|---|---|
| DE | 1 452 782 | 3/1969 |
| DE | 3 726 392 | 2/1989 |
| DE | 4 335 318 | 4/1994 |
| GB | 1041119 | 9/1966 |
| JP | 62-148035 | 7/1987 |
| JP | 62-148036 | 7/1987 |
| JP | 62-148039 | 7/1987 |
| JP | 62-148040 | 7/1987 |
| SU | 1 299 669 | 3/1987 |
| WO | WO 93/14893 | 8/1993 |

TOOL ASSEMBLY EMPLOYING A FLEXIBLE RETAINER

CROSS-REFERENCE TO RELATED APPLICATIONS

This application is a divisional of U.S. patent application Ser. No. 10/219,775, filed on Aug. 15, 2002 now U.S. Pat. No. 6,785,959 B2. The disclosure of the above application is incorporated herein by reference.

BACKGROUND AND SUMMARY OF THE INVENTION

The present invention relates generally to a joint forming apparatus and specifically to a die and punch for forming a joint between sheets of material.

It is common within the metal forming industry to join pieces of sheet metal by punching or otherwise deforming them to cause an interlocking relationship in a localized area. However, these traditional joints have typically required shearing of the sheet material. Thus, these joints tend to leak and also have their corrosion resistant coatings destroyed.

More recently, an apparatus has been used for joining two or more sheets of material together by creating a leakproof and secure joint. These improved conventional joints are created by use of a punch acting against an anvil to produce what is known as a TOG-L-LOC® joint therebetween. Such a leak proof joint and tooling are disclosed in U.S. Pat. Nos. 5,267,383 and 5,177,861, both of which are entitled "Apparatus for Joining Sheet Material" and issued to Sawdon. The disclosures of these patents are incorporated by reference herewithin.

The conventional TOG-L-LOC® leak proof joints consist of two or more sheets of material having a button or joint formed therebetween by a uniformly cylindrical punch forcibly pushing a punch side sheet of material into interlocking engagement with a die side sheet of material. These conventional leakproof joints have seen tremendous commercial success for use in varied applications such as steel microwave ovens and aluminum automotive bodies.

The apparatus includes a punch assembly and a die assembly which are arranged on opposite sides of the sheet material to be joined. The die assembly includes an anvil that is surrounded by one or more radially moveable die blades. The die assembly may also include a rigid shield that coaxially and radially surrounds the anvil and the one or more die blades. The conventional die assembly also includes a coiled or bias spring to radially inwardly retain the one or more moveable die blades against the anvil while allowing movement radially outward during joint formation. Such a die assembly and apparatus are disclosed in U.S. Pat. No. 5,727,302, entitled "Die and Punch For Forming A Joint and Method of Making The Die," issued to Sawdon, and incorporated by reference herein. However, the use of the bias spring is not without drawbacks. For example, the bias spring is susceptible to trapping factory dirt and debris. The bias spring also requires the step of welding which increases production time and costs. Additionally, the bias spring may break where the wire is joined by welding. If this breakage occurs, the one or more die blades that were held against the anvil can become loose and fall out of the die assembly. Therefore, it is desirable to provide a retaining means that does not need to be concerned with weld durability and is less susceptible to trapping factory dirt and debris.

In accordance with the present invention, a flexible retainer for retaining die blades in a tool assembly is disclosed. The retainer comprises axially opposite top and bottom surfaces with an outer wall extending axially therebetween and having an outer axial length. The retainer has an inner wall that is generally concentric with and radially spaced inward from the outer wall. In another aspect of the present invention, a central opening in the retainer is configured and adapted to extend radially around the die blades so that the retainer retains the die blades in the die assembly while allowing radial movement of the die blades. A further aspect of the present invention provides a retainer with at least one channel that extends axially between the inner and outer walls.

In yet another aspect of the present invention, a die assembly for forming a joint between sheets of material is disclosed. The die assembly comprises an anvil, at least one die blade disposed adjacent the anvil, a flexible retainer, and a shield that coaxially and radially surrounds the anvil.

In yet another aspect of the present invention, a die retainer is colored or otherwise identified to correspond to a size of the die blade(s) so that the size of the die blade can be visually ascertained.

A method of making a die assembly that is used for forming a joint between at least two sheets of material is also provided.

The present invention is advantageous over prior constructions since the present invention is self cleaning of debris during operation. The present invention is further advantageous since the retainer is less expensive to manufacture and simple to assemble. Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

The following description of the preferred embodiment is merely exemplary in nature and is in no way intended to limit the invention, its application, or uses.

Figure 1:
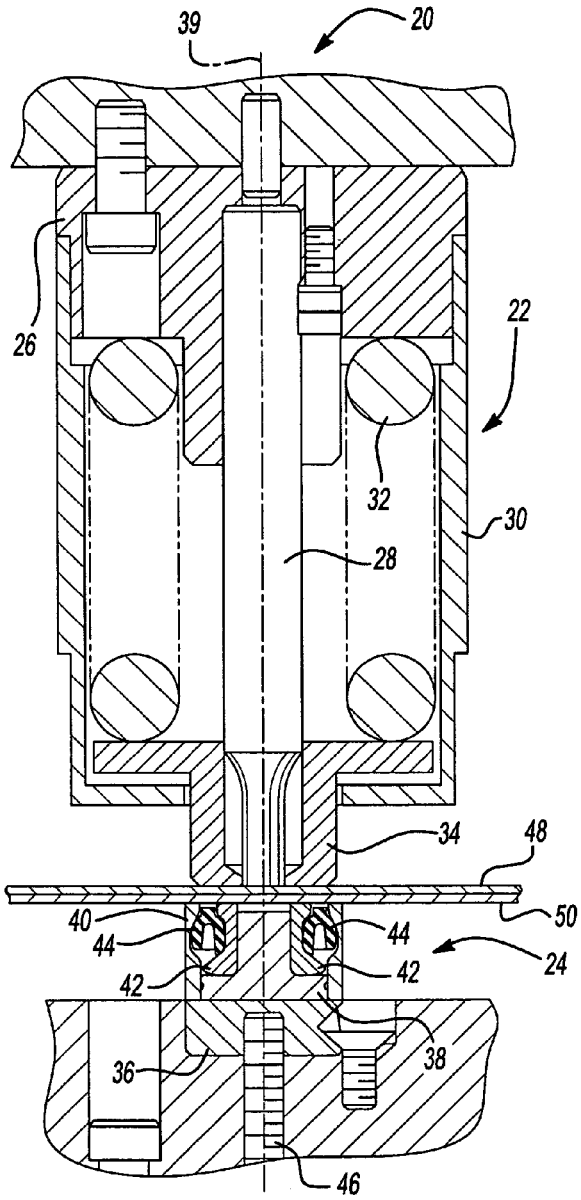
FIG. 1 is a longitudinal, cross sectional view showing a preferred embodiment of a tool assembly employing a flexible retainer of the present invention.
Figure 2:
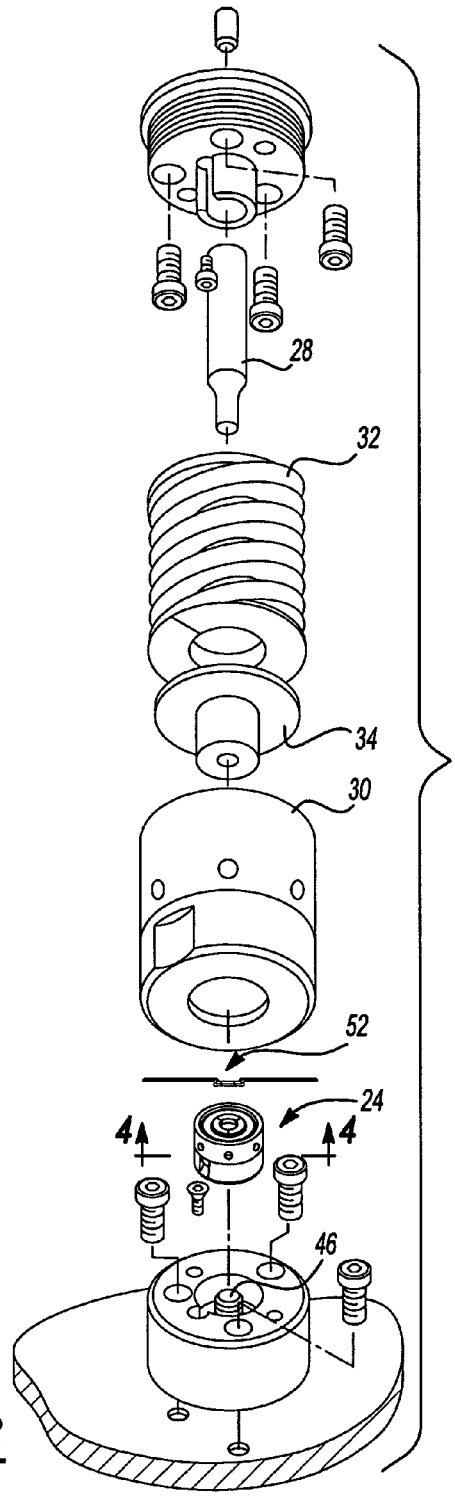
FIG. 2 is an exploded perspective view of the tool assembly according to the principles of the present invention.

Referring to FIG. 1, a preferred embodiment toggle press and tool assembly 20 of the present invention are diagrammatically shown employing the preferred embodiment of a punch assembly 22 and a die assembly 24 of the present invention. Toggle press 20 is pneumatically driven and made in accordance with U.S. Pat. No. 5,727,302 which is incorporated by reference above. Alternate presses, such as hydraulic in-line or toggle presses could also be employed with the punch and die assemblies of the present invention.

As can be best observed in FIG. 1, punch assembly 22 includes a punch holder 26, a punch 28, a housing 30, a compression spring 32 and a stripper 34. Aligned therewith, die assembly 24 includes a die body 36 having an anvil 38, an axial axis 39, a shield or guard 40, three movable die blades 42, a flexible retainer 44, and a mechanical fastener, such as a bolt 46. At least two sheets of deformable material 48 and 50 can be deformed between punch assembly 22 and die assembly 24 so as to create an interlocking clinch joint 52, which is preferably a leak proof joint. While three extendably moveable die blades 42 are preferably disclosed herein, it should also be appreciated that more or less than three die blades 42 can be disposed around anvil 38 and still be within the scope of the invention as defined by the claims.

Figure 3:
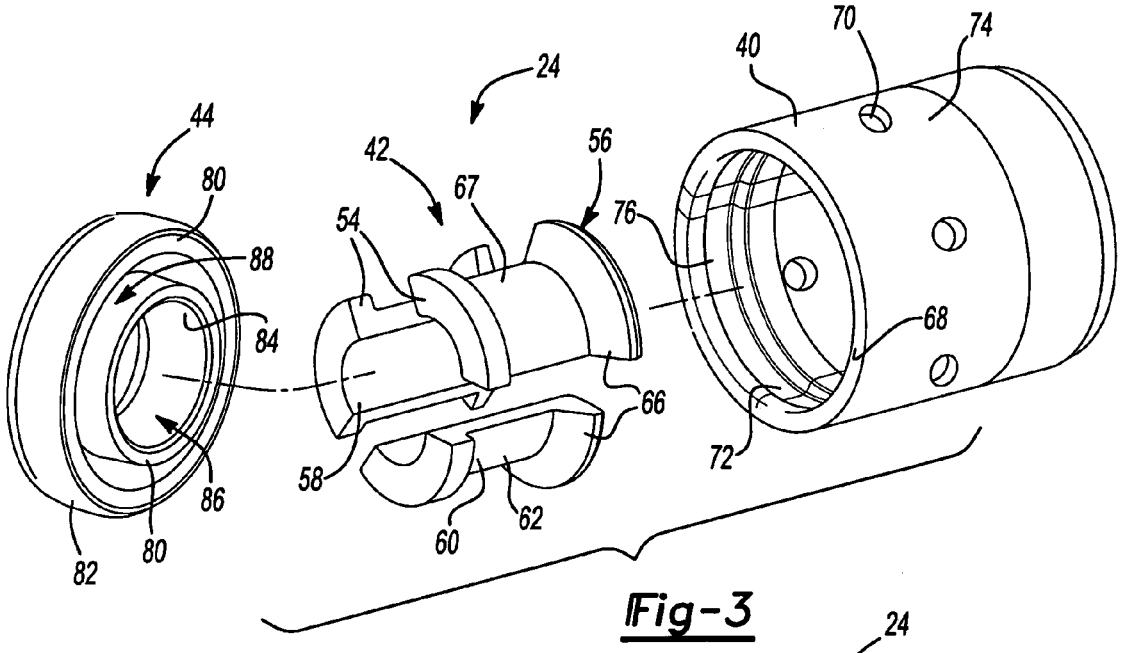
FIG. 3 is an exploded perspective view of a die assembly employed in the tool assembly of FIG. 2.
Figure 4:
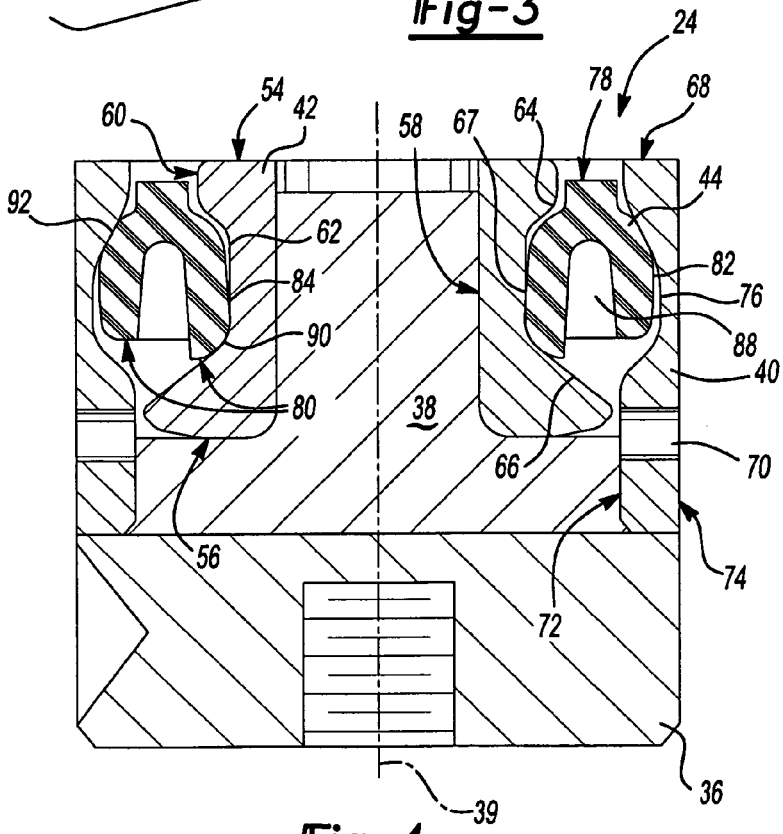
FIG. 4 is a cross sectional view, taken along line 4—4 of FIG. 2, of the die assembly in a nominal position according to the principles of the present invention.
Figure 5:
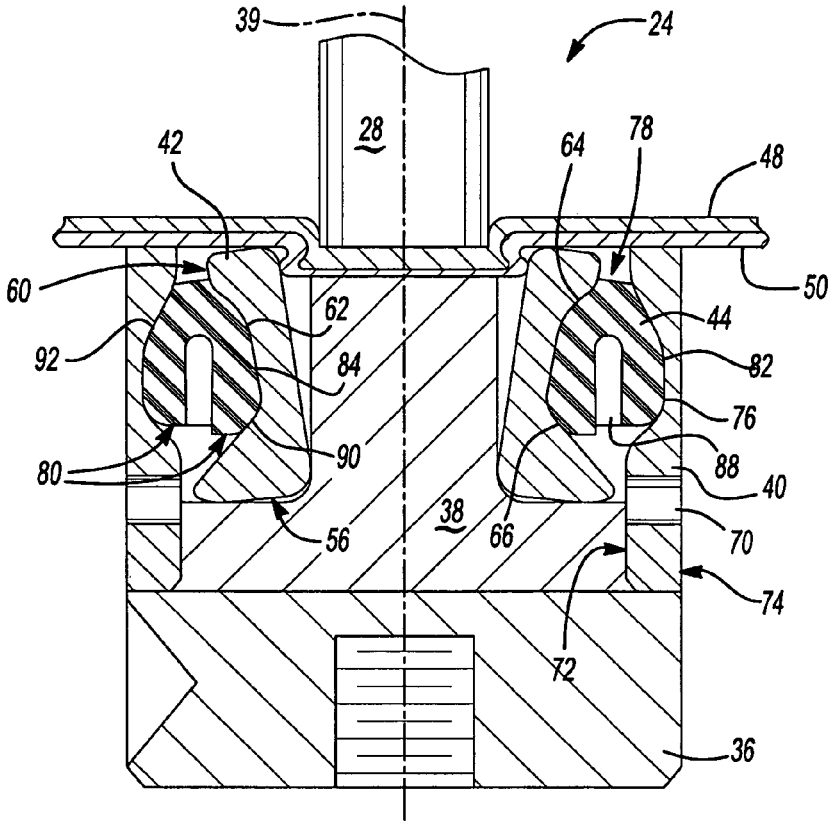
FIG. 5 is a cross sectional view, taken along line 4—4 of FIG. 2, of the die assembly forming a joint therein according to the principles of the present invention.

Referring to FIGS. 3–5, each die blade 42 has axially opposite upper and lower surfaces 54, 56 and radially opposite inner and outer surfaces 58, 60 that extend axially between the upper and lower surfaces 54, 56. Preferably, the upper and lower surfaces are substantially parallel. Die blades 42 are positioned radially around anvil 38 with inner surfaces 58 in contact with anvil 38. Outer surface 60 has a radial recess 62 that is defined by upper and lower tapered portions 64, 66 with a central portion 67 therebetween. Central portion 67 is substantially parallel to the inner surface 58. Also, inner surface 58 and central portion 67 are parallel with punch advancing axial axis 39 when the die assembly 24 is in a nominal position, as shown in FIGS. 1 and 4. Optionally, but preferably, the upper surface 54 is substantially coplanar with an upper edge 68 of the shield 40 prior to joint 52 being formed within die assembly 24. This coplanar nature of the upper surfaces 54 of die blades 42 (when in their nominal positions) and upper edge 68 of the shield 40 provides for improved support of material sheets 48, 50 during joint formation and removal from die assembly 24. Material sheets 48, 50 are preferably mild steel or commercial stamping steel but may also be any other deformable material and may further be of varying thicknesses. As can be seen in FIG. 4, the lower surface 56 of the die blades 42 extend radially outwardly further than the upper surfaces 54. The lower surface 56 has a rounded corner at the transition of the inner surface 58 to the lower surface 56. Additionally, the lower surface 56 is rounded as it extends towards the lower tapered portion 66 and the inner surface 58. The length and rounding of the lower surface 56 facilitates the radial movement of the die blade 42 in response to forming the interlocking clinch joint 52, as can be seen in FIG. 5. The lower surface 56 also has a substantially flat portion between the inner surface 58 and the outer surface 60 that provides stability of the die blades 42 when positioned on the anvil 38 while still allowing radially outward movement of the die blades 42 when forming interlocking clinch joint 52.

Shield 40 includes six apertures 70 that extend between the inner and outer surfaces 72, 74. The inner surface 72 has an annular recess 76. The annular recess 76 is configured and adapted to engage with a portion of the retainer 44, as will be described in more detail below. The shield 40 can be attached to the die body 36 in a variety of ways. For example, the shield 40 can snap fit onto the body 36 or can be retained with mechanical fasteners (not shown). The apertures 70 allow for self cleaning of the die assembly 24. Such self cleaning is achieved during normal movement of the die blades 42 and the retainer 44. Accordingly, any lubricating or cooling fluid as well as dirt, sheet material oil and other debris may be expelled through apertures 70. A shield having such self cleaning capabilities is disclosed in U.S. Pat. No. 5,727,302, which is incorporated by reference above.

Figure 6:
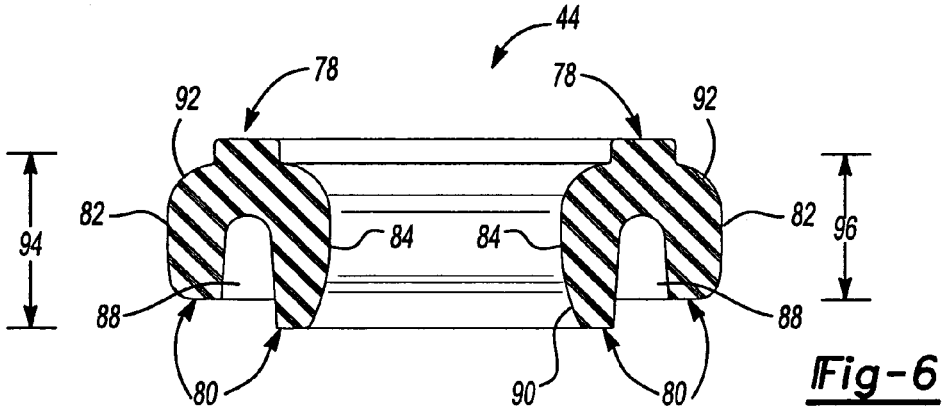
FIG. 6 is a cross sectional view of the flexible retainer of the present invention.

Referring now to FIG. 6, the retainer 44 has axially opposite top and bottom surfaces 78, 80. There is an outer wall 82 that extends from the top surface 78 to the bottom surface 80 and defines an outer periphery of the retainer 44. As can be seen, the outer periphery is generally circular. The retainer 44 has an inner wall 84 that is radially spaced inward from and is generally concentric with the outer wall 82. The inner wall 84 extends axially from the top surface 78 to the bottom surface 80 and defines a central opening 86, as shown in FIG. 3, that extends axially through the retainer 44. As can be seen, the central opening 86 is generally circular in shape.

There is a channel 88 that extends axially between the inner and outer walls 82, 84. The channel 88 extends axially from the bottom surface 80 toward the top surface 78 and annularly encircles central opening 86. Annular channel 88 causes the retainer 44 to have a generally inverted U-shaped cross sectional shape when oriented as shown in FIG. 6. However, it should be understood that other configurations for the annular channel 88 can be employed without departing from the scope of the invention as defined by the claims. For example, the annular channel 88 could be an inverted V-shaped, or semi circular shaped channel although the compression forces may vary.

The retainer 44 is injection molded from a chemically resistant material so that the retainer 44 can withstand exposure to various solvents that may exist in the forming of the interlocking clinch joint 52. For example, the retainer 44 may be exposed to lubricating or cooling fluid, sheet material oil, or other solvents. The retainer 44 is also made from a material that is abrasive resistant because, in addition to the fluids that were discussed above, the retainer 44 is also exposed to abrasive materials such as dirt, material flaking off the material sheets 48, 50 and other debris. These materials can fall into the die assembly 24 wherein movement of the die blades 42 and the retainer 44 can cause abrasion on the retainer 44 and premature failure. The use of a chemically and abrasion resistant material can increase the durability of the toggle press 20 and, more specifically, of the retainer 44. Additionally, the retainer 44 is preferably resilient and made from an elastomeric material that allows the retainer 44 to stretch and compress in response to movement of the die blades 42. To accomplish this, the retainer 44 can be made from a variety of materials. For example, the retainer 44 can be made out of urethane. Also, the retainer 44 can be made out of PVC, such as PVC-6712, or Nitrile WT-2037 which is similar to Buna-N. Alternatively, the retainer 44 can be made from a natural rubber. Additionally, the retainer 44 has a hardness of about 70A durometer.

The retainer 44 is positioned in die assembly 24 so that the retainer 44 radially encircles or surrounds the die blade 42 and the anvil 38. The inner wall 84 of the retainer 44 engages with the outer surface 60 of the die blades 42 to retain the die blades 42 against the anvil 38. The outer wall 82 of the retainer 44 engages with the inner surface 72 of the shield 40 to help retain the die blades 42 within the die assembly 24. A rounded lower portion 90 of the inner wall 84 engages with the lower tapered portion 66 of the die blades 42 while a rounded upper portion 92 of the outer wall 82 engages with an upper portion of the annular recess 76 in shield 40 when the die assembly 24 is in a nominal position, as shown in FIG. 4. This configuration of the retainer 44 prevents the die blades 42 from falling out of the die assembly 24 when the die assembly is being moved around or inverted while also allowing the die blades 42 to move radially outwardly when forming the interlocking clinch joint 52, as can be seen in FIG. 5. To facilitate the specific contact points of the retainer 44 with the die blades 42 and shield 40, the inner wall 84 has a longer axial length 94 than an axial length 96 of the outer wall 82. The longer axial length 94 of the inner wall 84 ensures that the rounded portion 90 engages with the lower tapered portion 66 of the die blade 42. Additionally, the inner and outer walls 84, 82 are generally parallel or at least have central portions between the top and bottom surfaces 78, 80 that are generally parallel, as can be seen in FIG. 6. The generally parallel portions are aligned with the axial axis 39 when the die assembly 24 is in the nominal position.

The annular channel 88 provides space for the retainer 44 to move when stretched and/or compressed by the die blades 42 moving in response to forming an interlocking clinch joint 52. That is, the annular channel 88 will be compressed, as shown in FIG. 5, during formation of interlocking clinch joint 52 and thereby enable the die blades 42 to move radially outward within the confined space between the anvil 38 and the shield 40. The amount of compression of the annular channel 88 will vary depending upon the configuration of the retainer 44 and the movement of the die blades 42 when forming an interlocking clinch joint 52. For example, as shown in FIG. 5, the annular channel 88 can be partially compressed when forming interlocking clinch joint 52. However, it should be understood that while the annular channel 88 is shown as being only partially compressed, the annular channel 88 can be completely compressed when forming interlocking clinch joint 52 and still be within the scope of the invention as defined by the claims. The compression of the annular channel 88 pushes fluid and/or debris within the annular channel 88 outward and helps self clean the die assembly 24. The annular channel 88 thereby facilitates the forming of the interlocking clinch joint 52.

The dimensions of the retainer 44 are chosen so that the die blades 42 experience a retaining force that is of a predetermined magnitude and allows for efficient operation of the toggle press 20 and the formation of interlocking clinch joints 52 while still preventing the die blades 42 from inadvertently being removed from the die assembly 24. The predetermined retaining force can be varied depending upon the size of the toggle press 20 and the size of the interlocking clinch joint 52 to be formed thereby. As can be seen in FIG. 4, the die blades 42 are preloaded or restrained against the anvil 38 by the retainer 44 in the nominal position to prevent inadvertent removable of the die blades 42 from the die assembly 24.

The toggle press 20 and/or the punch and die assemblies 22, 24 can be provided in a variety of sizes depending upon the thickness of the material sheets 48, 50 and/or the size of the interlocking clinch joint 52 to be formed. To facilitate different size interlocking clinch joints 52, the die blades 42 come in a variety of sizes. The different sizes of the die blade 42 can be visually difficult to differentiate. Therefore, the retainer 44 is preferably made in various colors that correspond to the various sizes of the die blades 42. For example, one size of die blades 42 utilizes a retainer 44 that is red while different size die blades 42 utilize a retainer 44 that is blue in color. By having a retainer 44 colored to correspond to the size of the die blades 42, a user of the toggle press 20 can quickly and easily ascertain the size of the die blades 42 within a die assembly 24 so that the correct die assembly 24 can be utilized in the toggle press 20. Alternatively, and/or additionally, indicia can be placed on a top surface 70 of the retainer 44. The indicia can include information relating to the size of the die blade 42 within the die assembly 24 or other raised or depressed formations corresponding to die blade sizes.

The interlocking clinch joint 52 is formed by axially moving the punch assembly 22 toward the die assembly 24 and causing the punch 28 to deform the material sheets 48 and 50 between the die blades 42 and the anvil 38. As can be seen in FIG. 5, the upper portions of the die blades 42 will move radially outwardly in response to the punch 28 pushing the material sheets 48, 50 toward the anvil 38 and between the die blades 42. Once the interlocking clinch joint 52 has been formed, the punch 28 is moved away from the anvil 38 and back into the punch assembly 22. The interlocking clinch joint 52 then retains the material sheets 48, 50 together. The toggle press 20 of the present invention thereby forms an interlocking clinch joint 52 that retains material sheets 48 and 50 together.

While the preferred embodiments of this toggle press 20 have been disclosed, it should be appreciated that various modifications may be made without departing from the scope of the present invention. For example, the shield may be deleted, or may be attached to the die body by set screws, welding or other such attachment means. A number of other polygonal or curve shapes may be used for the disclosed cleaning apertures 70 within the shield. Additionally, the apertures 70 can be circular in shape or take on a variety of other shapes, and can number more or less than six and still be within the scope of the invention as defined by the claims. Moreover, many other punch and/or punch assemblies with similar configurations may be employed in combination with the die assembly of the present invention. While specific materials of construction and hardness of the retainer 44 have been disclosed, it should be understood that other materials and hardnesses, as will be apparent to those skilled in the art, can be employed without departing from the scope of the invention as defined by the claims.

While the outer periphery of the retainer 44 is shown as being generally circular, it should be understood that the outer periphery can take on other shapes depending upon the shape of the punch 28, anvil 38, and/or die blades 42. For example, as shown in U.S. Pat. No. 5,267,383 which is incorporated by reference above, the outer periphery can be generally rectangular. Such variations are within the scope of the invention as defined by the claims. Likewise, it should be understood that the central opening 86 can also take on other shapes depending upon the shape of the punch 28, anvil 38, and/or die blades 42. Such other shapes are within the scope of the invention as defined by the claims.

The at least one channel 88 can take a variety of forms. For example, the at least one channel 88 can be a plurality of discreet channels that are spaced around the central opening 86. The channels 88 can be slots, or other configurations. Additionally, it is possible that the channels 88 can be discreet enclosed voids or hollow cavities within the retainer 44 that are spaced around the central opening 86. However, when the channels 88 are discreet enclosed voids, the self cleaning advantage discussed above may not be realized due to the channels being enclosed.

It should further be understood that while the terms, upper, lower, inner, outer, radial, axial and others are used to describe the present invention, such usage is to convey relative relationships between various aspects of the present invention. As such, these terms should not be construed as being absolute terms.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method of making and using a die assembly used for forming a joint between sheets of material, the die assembly having die blades, an anvil, and a flexible annular member with radially spaced apart first and second walls with a channel therebetween, the method comprising:

(a) positioning the die blades adjacent a periphery of the anvil;

(b) securing the die blades to the anvil by positioning the flexible annular member concentrically around the die blades;

(c) applying a radially inward retaining force on the die blades with one of the walls of the flexible annular member, said retaining force retaining the die blades adjacent the anvil while still allowing radial movement of the die blades;

(d) flexing the first wall of the flexible annular member relative to the second wall of the flexible annular member when the die blades move outwardly; and (e) allowing debris to exit the channel between the walls of the flexible annular member.

2. The method of claim 1, further comprising:

positioning a substantially rigid shield coaxially and radially around the anvil, the die blades, and the flexible annular member so that the shield is in contact with the flexible annular member and thereby retains the die blades in the die assembly.

3. The method of claim 2, wherein the step of positioning the shield comprises positioning the shield so that one of the walls of the flexible annular member is in contact with an annular recess in an inner surface of the shield.

4. The method of claim 3, further comprising:

forming the flexible annular member into a substantially U-cross-sectional shape from a polymeric material.

5. The method of claim 1, wherein (b) includes positioning the flexible annular member so that the channel opens towards a bottom surface of the die assembly.

6. The method of claim 1, further comprising:

molding the flexible annular member in a predetermined color corresponding to a size of the die blades.

7. A method of forming a joint between sheets of material using a punch and a die assembly having an anvil, a plurality of die blades, and a flexible annular retainer having first and second walls radially spaced apart with a cavity therebetween, the method comprising:

(a) positioning two sheets of material adjacent one another and between the punch and die assembly;

(b) deforming the two sheets of material with the punch and die assembly thereby forming a joint that holds the two sheets of material together, deforming the two sheets of material including:

(i) moving the punch and/or anvil relative to and toward one another;

(ii) resisting radial outward movement of the die blades relative to the anvil with one of the walls of retainer; and (iii) moving the punch away from the anvil.

8. The method of claim 7, wherein (b) includes flexing the first and second walls of the retainer relative to one another with movement of the blades.

9. The method of claim 8, wherein the cavity is an annular channel and flexing the first and second walls includes expelling material from the channel as the first and second walls are flexed relative to one another.

10. The method of claim 8, wherein flexing the first and second walls includes flexing a radially innermost one of the walls outwardly toward a radially outermost one of the walls as the die blades move radially outwardly away from the anvil.

11. The method of claim 7, wherein (b) includes moving the die blades toward the anvil with one of the walls of the retainer as the punch is moving away from the anvil.

12. The method of claim 7, wherein the die assembly includes a substantially rigid stationary shield that coaxially and radially surrounds the anvil and is engaged with one of the walls of the retainer and (b) includes resisting radially outward movement of the retainer with the shield.

13. The method of claim 7, wherein (b) includes deforming the sheets of material without piercing through the sheets of material thereby forming a leak-proof joint.

14. A method of using a die assembly to form a joint between sheets of material, the die assembly including an anvil, die blades disposed around the anvil, an annular flexible retainer radially surrounding the die blades and having radially spaced apart first and second walls with a channel therebetween, and a substantially rigid stationary shield coaxially and radially surrounding the anvil, the die blades and the retainer, the method comprising:

(a) positioning at least two sheets of material adjacent one another and adjacent the die assembly;

(b) deforming the sheets of material together with the die assembly thereby forming a joint locking the sheets of material together, deforming the sheets of material together including:

(i) moving the die blades radially outwardly relative to the anvil; and (ii) resisting radial outward movement of the die blades relative to the anvil with a radially innermost one of the walls of the retainer engaged with the die blades and a radially outermost one of the walls of the retainer engaged with the shield.

15. The method of claim 14, wherein (b) includes expelling material from the channel as the die blades are moved radially outwardly.

16. The method of claim 15, wherein expelling material from the channel includes expelling said material from the die assembly through an opening in the shield.

17. The method of claim of claim 14, wherein (a) includes positioning the sheets of material against the shield.

18. The method of claim 14, wherein (b) includes deforming the sheets of material without piercing through the sheets of material thereby forming a leak-proof joint.

19. A method of assembling a joint forming mechanism, the method comprising:

(a) radially surrounding an anvil with die blades; and (b) disposing a flexible annular retainer having radially spaced apart walls with a space therebetween around said die blades with a radially innermost one of said walls engaged with said die blades and an axially shorter radially outermost one of said walls radially spaced away from said die blades.

20. The method of claim 19, further comprising positioning a substantially rigid shield coaxially with and radially around said anvil, said die blades and said retainer with said shield engaging with said outermost one of said walls.

21. The method of claim 20, wherein positioning said shield includes positioning said shield with an annular recess in said shield engaged with said outermost one of said walls.

22. The method of claim 19, wherein said space is a generally U-cross-sectional shaped channel and (b) includes disposing said flexible retainer around said die blades with said channel opening in a direction substantially opposite that of a joint forming surface of said die blades.

* * * * *